United States Patent [19]

Spring

[11] 4,230,213

[45] Oct. 28, 1980

[54] LIQUID REJECTING COIN CHUTE

[75] Inventor: Carl E. Spring, La Crosse, Wis.

[73] Assignee: La Crosse Cooler Company, Inc., La Crosse, Wis.

[21] Appl. No.: 973,510

[22] Filed: Dec. 26, 1978

[51] Int. Cl.[3] ..... G07F 3/04

[52] U.S. Cl. ..... 194/1 K; 194/97 R

[58] Field of Search ..... 194/1 C, 1 R, 1 K, 97 R, 194/2, 9, 10, 102, 13; 232/45, 58, 7, 55; 193/1

[56] References Cited

U.S. PATENT DOCUMENTS

| | | | |
|---|---|---|---|
| 2,250,047 | 7/1941 | Mills | 194/97 R |
| 2,865,561 | 12/1958 | Rosapepe | 232/7 |
| 3,589,493 | 6/1971 | Hall | 194/102 |

*Primary Examiner*—Stanley H. Tollberg

*Attorney, Agent, or Firm*—Wheeler, Morsell, House & Fuller

[57] ABSTRACT

A coin operated dispensing machine has a coin chute and an electrical coin mechanism which is subject to malfunction when exposed to liquid entering through the coin chute. The coin mechanism is protected from such liquid by providing the coin chute with a liquid reject mechanism including a liquid pervious gate extending across the chute and which separates the path of coins from the path of liquid. Coins are diverted laterally for delivery to the coin mechanism. Any liquid is discharged downwardly through the gate and into a liquid trough. A splash guard is mounted between the liquid trough and the coin mechanism.

5 Claims, 11 Drawing Figures

LIQUID REJECTING COIN CHUTE

BACKGROUND OF THE INVENTION

Conventional coin-operated dispensing machines have coin chutes which deliver coins directly into the coin mechamism. The coin mechanism is typically electrically operated. In the event salt water or other electrically conductive liquid is squirted into the coin chute, it will follow the coin path into the coin mechanism and may short circuit the coin mechanism to result in a malfunction thereof in which stored coins are ejected from the machine through the coin return chute. This is known as "jackpotting" the machine and results in financial loss to the owner or lessee of the machine.

SUMMARY OF THE INVENTION

The present invention circumvents "jackpotting" the machine by modifying the coin chute to reject liquid therefrom. This is accomplished by separating the path of coins from the path of any liquid therein. The modified coin chute will deliver coins to the coin mechanism but will reject or discharge liquid from the chute and prevent it from entering the coin mechanism. In preferred embodiments, the mechanism for separating the path of coins from the path of liquid comprises a liquid pervious gate extending across the chute. The chute is vertically oriented so that any liquid injected thereinto will fall through the chute and through the liquid pervious gate into a liquid trough through an opening in the bottom of the chute. The liquid falls through the liquid pervious gate without being diverted thereby. Coins, however, are intercepted by the gate and are diverted laterally into the coin mechanism which is offset laterally from the chute.

Accordingly, the coin mechanism will operate normally and will function to dispense articles properly in response to introduction of proper denomination coins. However, any liquid which enters the coin chute will fall through the coin chute into the liquid discharge trough and will not enter the coin mechanism to cause any malfunction therein.

A splash guard or shield is disposed between the liquid trough and the coin mechanism to guard the coin mechanism from any liquid splash which might tend to enter the coin mechanism.

The coin slot desirably comprises a round opening which will accept vertically oriented coins so that such coins will be advantageously aligned in the vertical direction to fall through the slot vertically.

Other objects, features and advantages of the invention will appear from the disclosure hereof.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
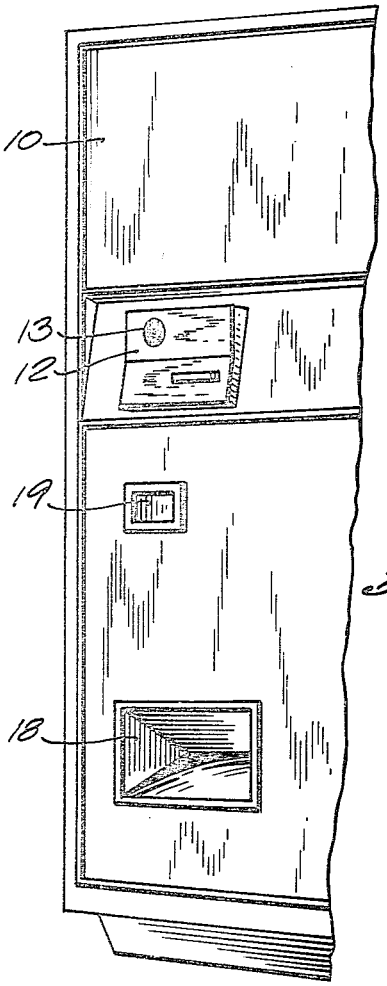
FIG. 1 is a fragmentary external perspective view of a coin-operated dispensing machine.
Figure 2:
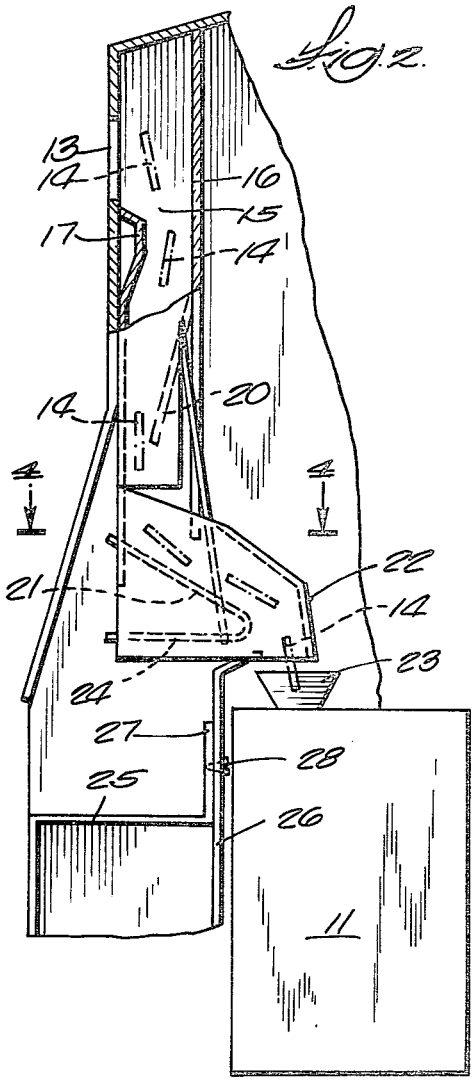
FIG. 2 is a vertical cross section taken through the coin chute.
Figure 3:
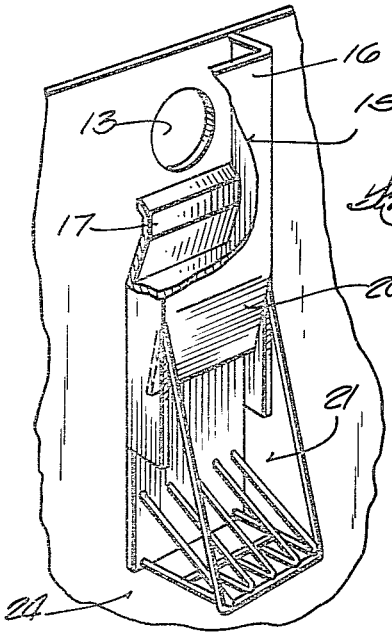
FIG. 3 is a fragmentary rear perspective view showing details of the coin chute.
Figure 4:
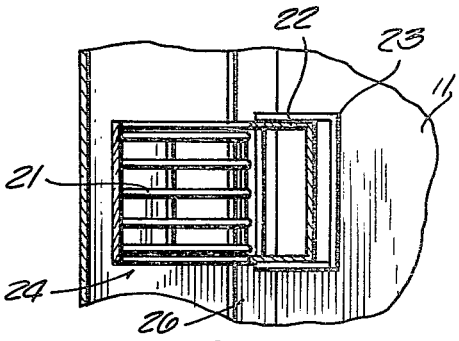
FIG. 4 is a fragmentary cross section taken along the line 4—4 of FIG. 2.

A coin-operated dispensing machine 10, such as for dispensing containers of beverages, candy, etc., is provided with a conventional coin mechanism 11 (FIG. 2) which is electrically operated. The machine is provided with a coin acceptance unit 12 which in the preferred embodiment of the present invention has a round coin receiving opening 13. In prior art machines of this type, coins are normally inserted into the machine through a horizontal slot so that the coin is also horizontally disposed when inserted through the slot. By utilizing a round opening 13, the coins 14 (FIG. 2) are vertically oriented as they are pressed through the slot 13. Accordingly, chute 15 can be relatively narrow in its front-to-rear dimension.

Dispensed articles are delivered to the customer through article delivery chute 18. Change and coins are returned to the customer through change chute 19.

Behind coin entry opening 13 there is a coin chute 15 which in the disclosed embodiment is formed in part by rear wall 16. Chute 15 may also be provided with a front apron wall 17 which helps orient the coins 14 to drop vertically down the chute 15. Coins 14 will drop down the chute 15 on the path indicated by the succession of broken line showings of the coins 14 in FIG. 2.

Wall 16 has a forwardly directed apron 20 to confine the coins 14 closely to this path. Near the bottom of the chute, an inclined liquid pervious wire grid diverter gate or deflector 21 extends laterally across the chute to deflect the coins 14 from their vertically oriented path and to divert them laterally and downwardly into an offset delivery spout 22 which is disposed over a coin receiving funnel 23 on the top of the coin mechanism 11. Coin mechanism 11 is offset laterally from the vertical axis of the chute 15.

The bottom of the chute 15 is also provided with a liquid pervious liquid discharge grid 24 which desirably constitutes a continuation of the wire grid 21. Accordingly, any liquid falling through gate 21 also falls through gate 24 and is discharged from chute 15. Any other form of liquid pervious gate or deflector may be used to divert coins laterally from chute 15 into the laterally offset coin spout 22.

Below chute 15 is a liquid receiving trough 25 which receives and drains away any water or other liquid which runs down the chute 15. Such liquid as enters the chute 15, as by squirting it through the coin receiving opening 13, will simply fall by gravity vertically down the chute 15 and between the grid wires in the wire grids 21, 24 and into the liquid trough 25.

Coin mechanism 11 is offset horizontally from the vertical axis of chute 15. A splash guard 26 intervenes between the liquid trough 25 and the coin mechanism 11 and its coin accepting funnel 23 to intercept and prevent any liquid splash from hitting the coin mechanism and/or entering the coin mechanism through the funnel 23. Trough 25 desirably has a rear flange 27 to which the splash guard 26 is attached by suitable fasteners, such as screws 28.

I claim:

1. In a coin-operated dispensing machine having a coin chute and an electrical coin mechanism which is subject to malfunction when exposed to entry of liquid through the coin chute, the improvement for protecting the coin mechanism from such liquid, including a vertically oriented chute having a front face with a coin slot therethrough and walls which obstruct direct flow of liquid injected in said coin slot into said coin mechanism, said coin slot comprising a round hole through which coins are admitted to the chute while vertically oriented and said chute providing a gravity free fall zone for liquid and coins entering said coin slot, an opening for liquid at the bottom of the chute through which the liquid is discharged and a liquid pervious gate extending across the chute and offset below said coin opening and above the liquid opening for diverting coins from the path of liquid and for delivering the coins to the coin mechanism, said gate having a deflecting surface inclined at an angle relative to the chute to intercept free falling coins and guide the coins with the faces of the coins generally parallel to the deflecting surface toward a coin spout which is horizontally offset from the liquid outlet and for discharge into the coin mechanism

2. The machine of claim 1 in which there is a liquid receiving trough beneath said chute to receive the liquid discharged therefrom.

3. The improvement of claim 1 wherein said gate is formed by spaced wires which are oriented in planes at right angles with a plane through said coin slot.

4. The improvement of claim 1 including an apron in said free fall zone of said chute to orient the coins vertically for the fall through said zone.

5. The machine of claim 1 in which there is a liquid receiving trough beneath the chute and alongside the offset coin mechanism to receive liquid discharged from the chute, and a splash guard between the trough and coin mechanism.

* * * * *